US006089496A

United States Patent [19]

Dorfel

[11] Patent Number: 6,089,496

[45] Date of Patent: Jul. 18, 2000

[54] WEB TENSION CONTROL SYSTEM FOR A WINDING STRUCTURE

[75] Inventor: Gerhard Walter Dorfel, Boll, Germany

[73] Assignee: Beloit Technologies, Inc., Wilmington, Del.

[21] Appl. No.: 08/959,738

[22] Filed: Oct. 28, 1997

Related U.S. Application Data

[63] Continuation of application No. 08/682,683, filed as application No. PCT/EP95/00330, Jan. 31, 1995, abandoned.

[30] Foreign Application Priority Data

Feb. 1, 1994 [DE] Germany ..... 44 02 874

[51] Int. Cl.[7] ..... B65H 18/14

[52] U.S. Cl. ..... 242/541.5; 242/413.1; 242/542.1

[58] Field of Search ..... 242/547, 541.5, 242/541.4, 541.6, 541.7, 542.1, 542.4, 413.1, 413.2, 542.2

[56] References Cited

U.S. PATENT DOCUMENTS

| | | | |
|---|---|---|---|
| 3,463,414 | 8/1969 | Eastcott | 242/75 |
| 3,837,593 | 9/1974 | Dorfel | 242/541.5 X |
| 3,871,598 | 3/1975 | Kataoka | 242/75 |
| 4,128,213 | 12/1978 | Komulainen | 242/541.5 |
| 4,238,084 | 12/1980 | Kataoka | 242/413.1 |
| 4,535,950 | 8/1985 | Lisnyansky | 242/413.1 X |
| 4,676,094 | 6/1987 | Hoffmann et al. | 242/541.5 X |
| 4,817,883 | 4/1989 | Hoffmann et al. | 242/541.5 X |
| 4,877,196 | 10/1989 | Heymanns | 242/541.5 |
| 5,553,806 | 9/1996 | Lucas | 242/547 X |
| 5,562,261 | 10/1996 | Beisswanger et al. | 242/541.7 X |

FOREIGN PATENT DOCUMENTS

| | | | |
|---|---|---|---|
| A-2436633 | 10/1983 | France . | |
| 188337 | 12/1936 | Germany . | |
| 1918903 | 4/1969 | Germany . | |
| 7427679 | 8/1974 | Germany . | |
| 2741083C2 | 9/1977 | Germany . | |
| 2932396A1 | 8/1979 | Germany . | |
| 8708849 | 2/1987 | Germany . | |
| 4123761A1 | 7/1991 | Germany . | |
| 9204667 | 4/1992 | Germany . | |
| A-04321112 | 1/1994 | Germany . | |
| 2028459 | 1/1990 | Japan | 242/413.1 |
| 2117935 | 3/1983 | United Kingdom . | |

OTHER PUBLICATIONS

"Emphasis On Better Rolls Means More Attention to Roll Structure", G. Forsberg, Paper Trade Journal Apr. 28, 1969, pp. 36–39.

"Rewinder Drives For the Paper Industry", Rudolf Hänsch, Das Papier, 26, 1972, pp. 20–209 (translated into English language).

The Vari–Step Modified Twin–Drum Roller System, Part 1; Moderated Roll Structure—Online and Offline Method To Determine Roll Hardness, Dr. Ewald G. Welp, Wickeltechnik (translated into English language).

"Real Slitting and Winding Machines, The Slitting and Winding of Web–Shaped Materials Requires the Utilization of an Exceptionally Diverse Technical Procedure", Papier + Kunststoff–Verarbeiter 11–77, pp. 28–40 (translated into English language).

*Primary Examiner*—Donald P. Walsh
*Assistant Examiner*—William A. Rivera
*Attorney, Agent, or Firm*—Raymond W. Campbell; Gerald A. Mathews

[57] ABSTRACT

A system to achieve an improved winding structure while winding webs (1, 1', 1" . . . ), especially paper webs, to obtain at least one wound web roll (5, 5', 5" . . . ) on a winding machine, comprises sensors 8A, 9A for determining torque load 8 and rider roll nip load 9, respectively, in order to change the tension remaining in the wound web. The winding machine is of a supporting drum type with at least two supporting drums (2, 3), at least one of these supporting drums preferably has elastic flexible surface (2', 3'). The torque and nip loads 8, 9, respectively, for changing the tension remaining in the wound web roll operate such that the tension of the web (1, 1', 1" . . . ) first decreases at increasing web roll diameter of said at least one web roll (5, 5', 5" . . .) during an initial winding phase, then stays approximately at the same level and, after winding further, decreases further at increasing wound web roll diameter during a final winding phase.

4 Claims, 2 Drawing Sheets

WEB TENSION CONTROL SYSTEM FOR A WINDING STRUCTURE

This applications is a continuation of copending application Ser. No. 08/682,683 on Jul. 25, 1996, now abandoned which is a 371 of PCT/EP95/00330 filed Jan. 31, 1996.

BACKGROUND OF THE INVENTION

1. Field of the Invention

The invention is related to a system (process and device) in order to get a perfect winding structure during the winding of web-like products especially made of paper to produce at least one wound paper web roll on a winding machine, with a pair of drums for supporting and starting the rotation of at least one wound paper web roll which is positioned in a winding bed made by the supporting drums, at least one of which preferably comprises an elastic flexible surface such as for example, a rubber cover. There are cooperating means, comprising a tensioned incoming traveling paper web, torque differentiation between the supporting drums and a rider roll engaging web roll being wound, all controlled by a computer which coordinates the elements of web tension, torque on the support drums and nip load provided by the roll to change the tensile stress remaining in the wound part.

2. Description of the Prior Art

In the above mentioned winding machines known in the art, the former supporting drums did not have an elastic flexible surface. Then, the winding structure could be influenced in such a way that the distribution of weights on the supporting drums was different and variable during the winding process and the pressure provided by the rider roll was dependent on the diameter of the roll, and was variable as well. Typically, the load on the supporting drum roll that was not wrapped by the web was linearly decresed depending on the increasing diameter of the roll, whereas the load on the first supporting drum in the winding direction (i.e., the so-called back drum) was linearly increased. The initial and final load values were controllable. It was typical as well that the load exerted by the rider roll to the web roll at first was increased according to the diameter of the roll, then decreased and did not exist any more at a defined diamter of the roll. The load itself was changeable.

It was typical as well that the tension exerted on the web that had to be wound was constant-independent of the diameter of the roll. Thus, the roll qualities of conventional two-drum winders, the supporting drums of which had a basically unflexible surface, could be improved.

The winding parameters did in no way take into account the friction values between the web and the supporting drums. Thereby, the forces exerted on the supporting drums and to the rider roll sometimes could not be transferred to the web. As a consequence slippage occured with respect to the web and the winding structure of the roll became insufficient.

The two-drum winders with at least one supporting drum with an elastic flexible surface (softnip principle) that were introduced in the market in the meantime were not successful with respect to the means for changing the wound tension of the web.

DE-GM 87 08 849 discloses a winder with two parallel drums and a rider roll that can be tilted as a whole to control the nip pressure. At the beginning of the winding process the rider roll exerts high pressure on the winding roll starting to build up. A tight core is obtained by this pressure, and also a positive speed differential between the drums and a corresponding back tension. During the following winding process the pressure of the rider roll is reduced. The back tension and the tilting of the whole winder is used to control the quality of the wound paper web rolls, i.e. the hardness. It is possible to provide the drums, especially the front drum with different coatings, i.e. a rubber coating.

A method for controlling the hardness of a winding roll by application of a different torque on back and front drum is disclosed in DE-A1-29 32 396. Hardness and the difference of the driving electrical current to apply different torque at the two drums follow according to the diameter of the roll. Hardness and current difference are kept at a constant value during a first phase. Afterwards, these values are decreased linearly. During a third phase these values are kept at a constant lower level. The first phase may be omitted. Neither a change of the back tension of the web nor a rider roll is revealed in this document.

GB-A-21 17 395 discloses a two drum winder with a rider roll whereby the web tension is controlled by controlling the speed difference between the two drums in dependence on the diameter of the roll which is already wound and in response to given speed signals representative of the speed of rotation of each drum. The torque of each drum follows a curve as depending on the speed differential and on the diameter of the winding roll. The torque curves can be divided into three phases. The torque on both drums is constant during the first and the third winding phase. While in the middle (i.e., intermediate portion) of the winding phase, the torque on the front drum is decreasing and the torque on the back drum is increasing at the same time. According to this document it is desired to keep the web tension constant throughout the roll. A method how to control the pressure exerted by the rider roll is not disclosed.

While GB-A-21 17 935 proposes to keep the wound-in tension of the web contact throughout the wound roll, the document FR-A-24 36 633 also teaches that the web tension should be kept constant during the first phase of winding, but on an elevated level, while roll diameter increases, and that the web tension should decrease after a first roll diameter D1 is reached and should be kept constant after a nominal tension at a second diameter D2 is reached, whereafter web tension will decrease again for the rest of the winding operation after a third diameter D3 is reached. However, no technical means is disclosed in the document as to how to achieve a web tension variation as hereinabove explained.

The invention starts from the general teaching of the FR-A-24 36 633 document, i.e., that during winding operation the wound-in tension of the web should be at an elevated level at the beginning of the winding operation and be decreased below the nominal tension towards the end of the winding operation.

While GB-A-21 17 935 and FR-A-24 36 633 documents propose to change the wound-in tension of the web formed to a growing roll, the invention has recognized that the tension of the web to be wound, i.e., the tension of the part of the web before the web reaches the roll, is to be reduced.

WELP, Ewald G. discloses in the paper Papier-und Kunststoff-Verarbeitung, September 1981, page 54 to 59, two drum winders with constant back tension in dependence on the roll diameter. A change of overspeed and different torque of the two drums is discussed. In what manner the torque is to follow the diameter of the roll is not mentioned.

FORSBERG, G. proposes in Paper Trade Journal, Apr. 28, 1969, page 36 to 40, to put almost all the torque into the front drum at the start and then gradually to transfer the torque from the from drum to the back drum.

KLEIN, Hugo Rollenschneid-und Wickelmaschinen. In: Papier und Kunstoff-Verarbeiter, 11–77, 5.28–40; Firmenschrift der Jagenberg-Werke G. Düsseldorf. Technische Informationen, III/314, eing. I: DPA 30.8 1965, S. 1–4, discloses a two drum winder, the front drum current of which decreases linearly, while the back drum current increases. Neither a dependence of the back tension on the diameter of the roll nor a dependence of the front drum torque during beginning or end of the winding process is revealed. Further, this document reveals a decrease of the pressure exerted by a rider roll in dependence on the diameter of the roll.

SUMMARY OF THE INVENTION

Being aware of the above it is an object of the invention to provide—in a system as mentioned above—the means for changing the tensile stress remaining in the wound paper web such that a more improved winding structure in the wound paper web roll can be realized with the help of such means—even if the softnip-principle is applied. It is a further object of the invention to prevent wrong adjustment nearly completely.

This invention solves this problem by decreasing the paper web tension at an initial rate during the initial winding phase, while the diameter of the web roll being wound is increasing, then maintaining the web tension approximately constant at another rate during the web winding process in the middle, or intermediate, phase of the web roll-up, and then decreasing the web tension at still another rate during the final phase of wound roll construction.

One of the advantages of the invention is that the tensile stress remaining in the already wound paper web roll decreases degressively as long as the diameter of the roll increases, even in case of two-drum winders operating according the softnip-principle. Another advantage is that an important fault in the roll structure can be avoided by preventing slippage between the roll(s) and the supporting drum due to the friction values of the specific web and the specific drums or drum covers.

The tensile stress remaining in the wound web can be changed in different ways when the process is applied. The subclaims consist of these possibilities that are explained in the following referring to the figures in view of a preferred embodiments of the invention.

DESCRIPTION OF THE PREFERRED EMBODIMENTS

Figure 1:
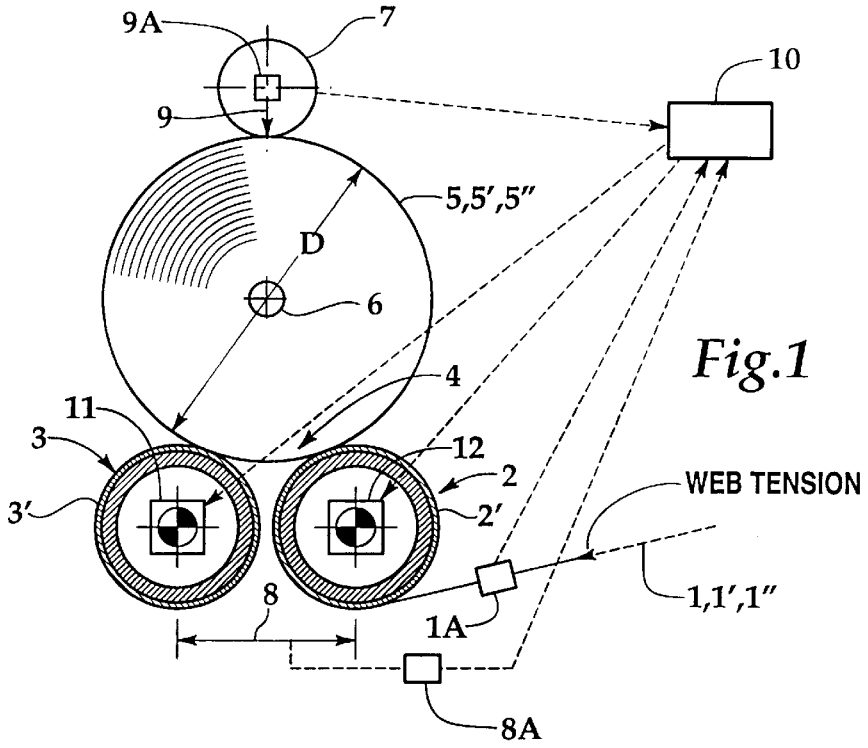
FIG. 1 shows in principle a winding machine according to the invention as viewed from one end of the supporting drum (i.e., a side elevational view)
Figure 5:
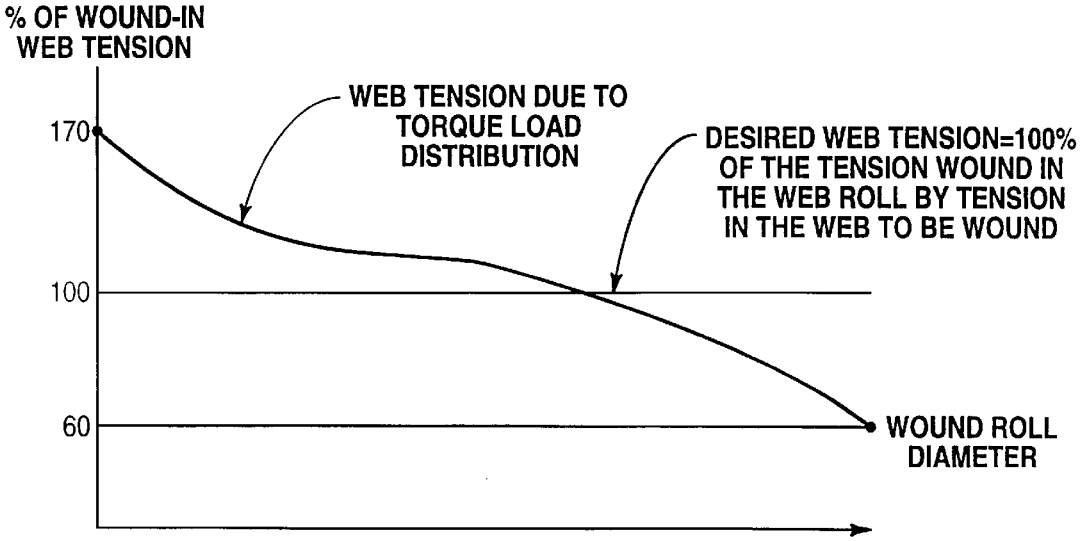
FIG. 5 shows an example for a practical curve of the tension of the web to be wound in—dependent on the diameter of the roll wound web.

In a winding machine according to FIG. 1, a first supporting roll, or support drum, 2 (i.e., the so-called back drum) as seen from the direction of at least one paper web 1, 1', 1", . . . to be wound with a hard surface (not shown) or an elastic flexible surface, or roll cover, 2'—which is already known per se—will be partly wound by the web, whereas another supporting roll, or support drum, 3 (i.e., the so-called front drum) that has—for instance—a less elastic flexible surface, or roll cover, 3', which is the second support drum according to the winding direction, is not wound by the paper web(s). The front and back support drums 3,2 are driven by motors 11, 12, respectively. Both supporting rolls form a winding bed 4, by which the wound web roll(s) 5, 5', 5", . . . which are formed from the web(s) 1, 1', 1", . . . , preferably on a core 6 are carried. The roll(s) is/are rotated by the supporting drums. A rider roll 7, which is very well known per se, rests, with adjustable pressurization, shown schematically by directional arrow 9 in FIG. 1, on roll(s) 5, 5', 5", to thereby provide a variable nip load against the paper web roll, . . . and is moved by the web roll 5, 5', 5" being wound i.e. it is without own driving device.

Figure 2:
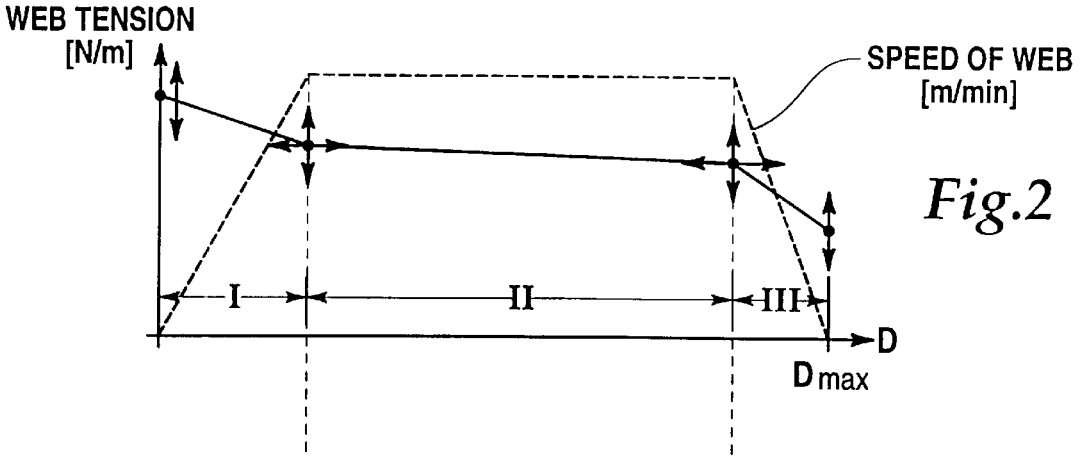
FIG. 2 shows a tension diagram of the web that is to be wound dependent on the diameter of the roll.

The tension on the web 1, 1', 1", which is shown schematically in FIG. 1 as being measured by sensor 1A, . . . that is to be wound and shown in FIG. 2 as dependent from the roll diameter will, during an initial winding phase I, be linearly decreased, at a relatively great rate (as compared with the rate in a subsequent intermediate rate II) then basically held at the same level or—as shown in the intermediate phase II and is so favoured—also linearly but less decreased than during the initial phase (i.e., decreases at a relatively slower rate III). During the final phase of the winding the tension decreases again to a higher degree (i.e., decreases at a relatively greater rate as compared with the rate in intermediate phase II) with respect to the increasing diameter of the roll until a given final diameter of the roll is reached and this particular winding process of winding is finished.

As the two or four arrows in the figures show (see FIG. 2 in the beginning and at the end of the initial phase, and in the final phase III) the tension and the change of the tension can in an adjustable way be changed—favourably at these points—according to the increasing diameter of the roll. Favourably, the initial phase is finished at the end of the acceleration phase of the supporting drum, and the final phase starts with the beginning of the brake phase of the supporting drums. In order to make that more clear, the speed diagram of the supporting drums 2 and 3 is also shown in FIG. 2 (in broken lines).

As one can see in FIG. 4 the change of the wound-in-tension can be achieved or supported by changing the load distribution indicated schematically by the number 8 in FIG. 1 on the supporting drums 2 and 3 in such a way that the load distribution during an initial winding phase changes to a relatively high degree, especially in a linear way, whereas in the following main (i.e., intermaediate) winding phase the distribution of load changes slower than in the initial phase according to the increasing diameter of roll. During the final winding phase the load distribution changes to a higher degree again. During this final winding phase it is favourably provided to vary the absolute load distribution each time at the beginning and at the end of the initial phase and of the final phase. The sum of the load of both supporting drums is shown as the zero line.

Figure 4:
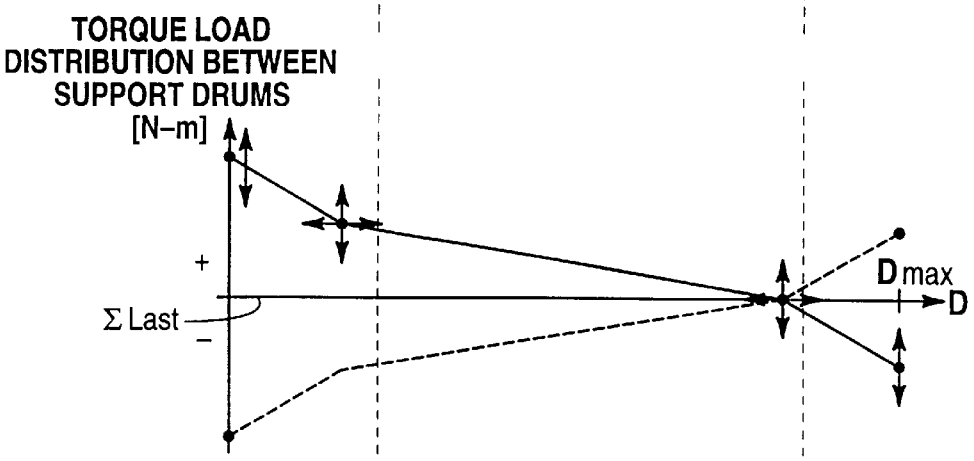
FIG. 4 shows a diagram of the wound-in web tension (which is comparable to a diagram of the support drum torque or load distribution) to the supporting drums according to FIG. 1 dependent on the diameter of the roll.

The uninterrupted line in FIG. 4 shows the load decrease of (second) supporting drum 3 (during increasing diameter of roll designated as the abscissa D of the coordinate diagram). The load increase of the (first) supporting drum 2 (shown as an broken line) follows automatically as long as the wound web roll 5, 5', 5", diameter D increases.

According to the invention, the tension of the web, to be wound, as in principle shown in FIG. 2, is the basis for the steps to be undertaken. Therefore, the distribution of torque load, shown schematically at number 8 in FIG. 1 between the supporting drums is affected in a way which assists the build-up of a tension in the web according to FIG. 2.

Figure 3:
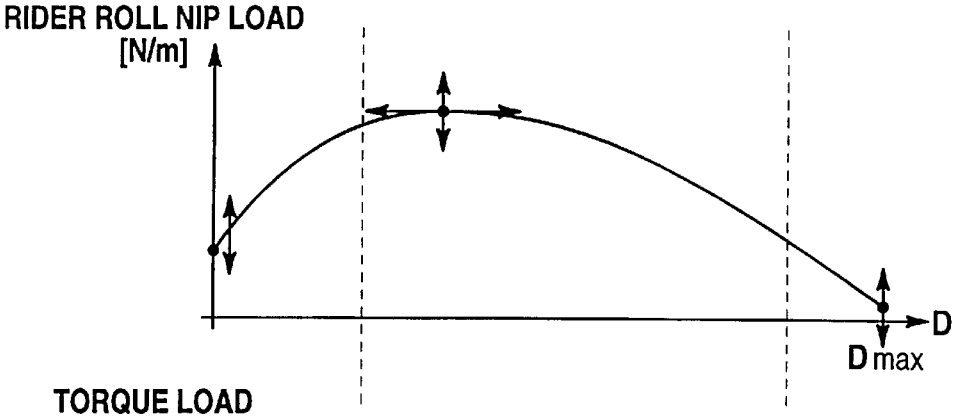
FIG. 3 shows a load diagram of a rider roll dependent on the diameter of the wound web roll.

In order to make sure that the desired load distribution according to FIG. 4 on the at least one roll 5, 5' 5" . . . is effected during all winding phases, the load designated by number 9 of the rider roll 7 which is depending on the roll diameter can also be changed in many ways. That is indicated in FIG. 3 by multiple arrows extending parallel to the axes of the coordinate system. Especially, the point of maximum load is changeable with regard to its absolute value as well as in relation to the roll diameter. It is typical that a certain load on the at least one roll 5, 5', 5", . . . remains until the desired winding diameter is obtained.

It is important to make sure that no slippage occurs between front drum 3 and winding bed 4. Slippage would disturb the winding structure of the roll. To avoid such slippage, the preselected set of values of web tension, load and load distribution in relation to the roll diameter (see FIGS. 3 and 4) are continuously surveyed or monitored by a computer 10 which compares these set of values with actual sensored process data. The sensored data is supplied by sensors 9A (supplier of rider roll nip data), 1A (supplier of traveling paper web tension data), and 8A (supplier of support load data in the nip lines of support between the web roll(s) 5, 5', 5" . . . and the support drums 2, 3, which sensors are in communication with computer 10 as shown in FIG. 1 Said computer recalculates a new load or load distribution which makes sure that no slippage occurs in cases where the sensored data show that slippage might otherwise occur. For instance, the actual load (FIG. 3) may be too small to transfer the chosen load distribution or the maximum transferable load is nearly reached, so that slippage between back drum 3 and winding bed 4 may occur. In such cases—only shown as an example—the computer will recalculate the curve for the load and/or the load distribution in relation to the roll diameter in order to make sure that no slippage occurs. The new conditions are automatically used by the winding machine without the need of any action of the operator.

For the recalculation of said set of values for the load in the load distribution it is helpful to know the friction factors between the roll 5, 5', 5", . . . and the supporting drums, especially the back drum 3. This friction value can be stored for each type of paper and material of the supporting drum cover in the computer or automatically be measured and received by the computer.

We claim:

1. A process for winding a traveling, tensioned paper web utilizing a winding apparatus having at least two driven, front and back, support drums having parallel axes of rotation, and defining a winding bed between them, and a core for receiving the on-coming traveling paper web to be wound into a wound web roll thereon, as the core is disposed in the winding bed supported by the support drums, and a rider roll for engaging the web roll along a nip line of contact therewith as the web roll is being wound, comprising the steps:

1) decreasing the wound-in tension in the web roll being wound in an initial phase of the wound web roll winding process by selectively distributing the torque load between the driven support drums;

2) further decreasing the wound-in tension in the web roll being wound in a subsequent intermediate phase of the wound web roll winding process by further selectively distributing the torque load between the driven support drums, the rate of wound-in tension of the web in the wound web roll in the intermediate phase decreases at a rate which is less than the rate of wound-in tension in the initial phase;

3) still further decreasing the wound-in tension in the web roll being wound in a still further final phase of the wound web roll winding process by further selectively distributing the torque load between the driven support drums, the rate of wound-in tension of the web roll in the final phase is greater than the rate of wound-in tension in the intermediate phase;

4) coordinating the rider roll nip with the rates of wound-in tension during the initial, intermediate and final phases.

2. A process for winding a traveling, tensioned paper web as set forth in claim 1, wherein:

the surface of the back drum is elastically flexible and the surface of the front drum is also elastically flexible, with the surface of the front drum being less elastically flexible than the surface of the back drum.

3. A process for winding a traveling, tensioned paper web, as set forth in claim 1, wherein:

the surface of the back drum is hard relative to the elastically flexible surface of the front drum.

4. A process for winding a traveling, tensioned paper web, as set forth in claim 1, wherein:

the surfaces of at least one of the front and back drums is elastically flexible, with the surface of the front drum being less elastically flexible than the surface of the back drum.

* * * * *